US005313753A

United States Patent [19]

Sanger

[11] Patent Number: 5,313,753

[45] Date of Patent: May 24, 1994

[54] CONSTRUCTION WALL PANEL AND PANEL STRUCTURE

[76] Inventor: Wallace D. Sanger, 11333 Acme Rd., West Palm Beach, Fla. 33414

[21] Appl. No.: 20,303

[22] Filed: Feb. 19, 1993

Related U.S. Application Data

[63] Continuation-in-part of Ser. No. 750,511, Aug. 27, 1991, abandoned, and a continuation-in-part of Ser. No. 874,414, Apr. 27, 1992, abandoned, and a continuation-in-part of Ser. No. 3,396, Jan. 12, 1993, abandoned.

[51] Int. Cl.[5] ..... E04B 1/00

[52] U.S. Cl. ..... 52/251; 52/309.12; 52/405

[58] Field of Search ..... 52/251, 309.12, 309.17, 52/405, 707, 710, 127.7–127.9, 127.11, 127.12, 90.1, 91.1, 91.3, 293.3, 292, 295, 79.9, 79.12, 79.13, 79.14, 309.7, 309.11, 309.17, 541

[56] References Cited

U.S. PATENT DOCUMENTS

| | | | |
|---|---|---|---|
| 1,773,168 | 8/1930 | Brostrom | 52/405 |
| 1,840,304 | 1/1932 | Branson | 52/251 |
| 2,321,813 | 6/1943 | Henzel | 52/405 |
| 2,592,634 | 4/1952 | Wilson | 52/262 |
| 2,823,426 | 2/1958 | Dunlap | 52/541 |
| 3,245,185 | 4/1966 | Rowe | 52/293.3 X |
| 3,310,917 | 3/1967 | Simon | 52/91.1 |
| 3,415,023 | 12/1968 | Lebreton | 52/405 |
| 3,886,699 | 6/1975 | Bergmann | 52/582 X |
| 4,090,336 | 5/1978 | Carroll | 52/309.12 |
| 4,163,349 | 8/1979 | Smith | 52/309.16 X |
| 4,194,333 | 3/1980 | Paton | 52/710 X |
| 4,241,555 | 12/1980 | Dickens | 52/309.7 X |
| 4,291,513 | 9/1981 | Ankarswed | 52/405 X |
| 4,365,453 | 12/1982 | Lowe | 52/478 |
| 4,380,887 | 4/1983 | Lee | 52/405 |
| 4,422,997 | 12/1983 | Machnik | 264/274 |
| 4,494,353 | 1/1985 | Lewis | 52/741 |
| 4,512,126 | 4/1985 | Walston | 52/251 |
| 4,532,745 | 8/1985 | Kinard | 52/251 |
| 4,624,089 | 11/1986 | Dunker | 52/410 |
| 4,641,468 | 2/1987 | Slater | 52/309.7 X |
| 4,682,660 | 9/1988 | Raymond | 52/309.7 X |
| 4,751,803 | 6/1988 | Zimmerman | 52/414 |
| 4,815,243 | 3/1989 | Pardo | 52/405 |
| 4,841,702 | 6/1989 | Huettemann | 52/309 |
| 4,947,600 | 8/1990 | Porter | 52/235 |
| 4,974,381 | 12/1990 | Marks | 52/309 |

FOREIGN PATENT DOCUMENTS

| | | | |
|---|---|---|---|
| 0392610 | 10/1990 | European Pat. Off. . | |
| 514941 | 6/1976 | U.S.S.R. | 52/405 |

OTHER PUBLICATIONS

Macwall Concrete Systems.
Burke, The Concrete Supermarket.
Precast Concrete Wall Panels Dec. 1992.
Robert Snow Means Company, Inc. 1981.
Machnik Precast Concrete Wall Panel Research Report No. 78–77, Sep. 1980.
Building Construction Cost Data 1982 (Includes "The Weathercast Building System").

*Primary Examiner*—Carl D. Friedman
*Assistant Examiner*—Beth A. Aubrey
*Attorney, Agent, or Firm*—Frank L. Kubler

[57] ABSTRACT

A prefabricated panel for forming walls and roofs of buildings includes a concrete planar portion having a first face and a second face, at least one concrete rib projecting from the first face, at least one block of insulating material fitted adjacent to the first face and the at least one rib, a metal stud channel secured over at least one of the at least one rib, anchors for securing the panel to a foundation. A polystyrene strip is preferably contained within each metal stud channel. The anchors preferably include a first angle-iron plate having first and second planar portions, the first planar portion being contained within one of the concrete ribs and the second planar portion being exposed and parallel with the exterior of the rib, a second angle-iron plate having first and second planar portions, the first planar portion being fastened to the second planar portion of first angle iron plate and the second planar portion being secured to the foundation. A structure formed of such panels includes a foundation having a ledge around its edges and several of the panels positioned vertically on the ledge and secured to the foundation to form walls. Additional panels may be placed across the tops of the vertically positioned panels to form a roof. These additional panels have at least one slot for receiving the tops of the vertically positioned panels.

27 Claims, 12 Drawing Sheets

CONSTRUCTION WALL PANEL AND PANEL STRUCTURE

FILING HISTORY

This application is a continuation-in-part of patent application Ser. No. 07/750,511 filed on Aug. 27, 1991, now abandoned, of application Ser. No. 07/874,414 filed on Apr. 27, 1992, now abandoned and of application Ser. No. 08/003,396 filed on Jan. 12, 1933, now abandoned.

BACKGROUND OF THE INVENTION

1. Field of the Invention

The present invention relates generally to the field of panels for forming walls of buildings, and more specifically to a prefabricated panel having a concrete planar portion with at least one concrete rib extending from a face thereof and at least one block of polystyrene fitted adjacent thereto, and a metal stud channel containing a polystyrene strip secured over each at least one rib for receiving dry wall screws. The present invention also relates to a structure formed of such panels.

2. Background Information

Concrete block and other prior art wall designs formed upright and incrementally generally have irregular faces and weak cohesion. The placing of concrete blocks is only as accurate as the skill of the blocklayer permits. The resulting exposed, exterior face of the wall is always uneven to some extent, requiring a substantial stucco covering. More important is that the mortar used to join the concrete blocks is below the strength of properly hardened concrete and forms a relatively weak bond with the blocks. Hurricanes and other natural disasters can sometimes shatter such walls. Finally, the insulating properties of such walls are at most adequate.

Attempts have been made to solve these problems with a preformed wall panel. The panel of Walston, U.S. Pat. No. 4,512,126, issued on Apr. 23, 1985, for example, is formed of two layers of polystyrene fitted into a ribbed concrete shell in a multiple step, multiple pour process. Anchor hooks must be embedded in the floor slab when it is poured. Problems with Walston include time-consuming and expensive forming methods and awkwardness and complexity in anchoring procedures.

3. Description of the Prior Art

There have long been prefabricated wall panels for rapid construction of buildings. None teach panels combining high strength, maximum insulating properties, single pour formation, and solid, easy to use anchoring means.

Additional examples of prior panels include Lewis, U.S. Pat. No. 4,494,353, issued on Jan. 22, 1985. Lewis teaches a rigid, rectangular insulating member which fits within the U of opposing vertical hat channels and a bottom channel. The bottom channel is welded to a bottom plate which is secured by anchor bolts to a concrete foundation. Panel connector strips are welded to the hat channels and reinforcing rods extend through holes in the connector strips. Gunite is then sprayed over this structure to form the finished panel. Numerous and complicated metal parts make Lewis expensive. Also, two separate layers of concrete are required, adding pouring and curing time and expense.

Kinard, U.S. Pat. No. 4,532,745, issued on Aug. 6, 1985, discloses a wall formed of foam blocks and channels. The blocks, which have periodic vertical bores, are placed edge to edge. Then a channel with periodic holes is placed along the common top edge of the blocks so that the holes align with the vertical bores. Concrete is poured through the holes into the vertical bores, filling the bores and the channel, and hardens to form a solid skeletal structure. A wall can be formed of several block and channel levels. Kinard does not provide a strong external surface suitable for an outside wall.

Dunker, U.S. Pat. No. 4,624,089, issued on Nov. 25, 1986, is an anchor in the form of a plate having holes through which reinforcing rods extend, for holding reinforced sandwich panels together. An end of the anchor also wraps around a perpendicular mesh rod. Concrete is poured to form a carrier panel such that ends of several such anchors protrude therefrom. Then a layer of insulating material is fitted against the panel so that the protruding ends of the anchors punch through the insulating layer. Then rods for the mesh are fit through holes in the anchor protruding ends and another concrete layer is poured around the mesh and the anchor ends. This anchor holds two concrete layers around an insulating layer. Only the outside wall of most buildings needs to be this strong, so Dunker is wasteful of materials and needlessly expensive.

Marks, U.S. Pat. No. 4,974,381, issued on Dec. 4, 1990, describes another anchor member for joining the outer slabs of a sandwich panel. A metal slat has a hole in each end for receiving a reinforcing rod of each slab, and the slat extends through a middle insulating layer. This anchor is not intended to anchor the panel to a foundation, but is instead part of the internal panel structure. Marks, like Dunker, is another wasteful sandwich arrangement.

Porter, U.S. Pat. No. 4,947,600, issued on Aug. 14, 1990, teaches an interface for mounting a brick wall covering on an existing concrete wall or slab. One side of an angled member is attached to slab to form a shelf, additionally secured by a bracket. Studs extend through and join a foam layer to the slab. Mesh is placed over the foam layer and brick is laid on the shelf in front of the foam. Porter does not teach an effective, economical approach to constructing a new, insulated wall.

Huettemann, U.S. Pat. No. 4,841,702, issued on Jun. 27, 1989, discloses a three-layer panel. The middle panel is an insulating slab such as foam polystyrene. A sheet of particle board is joined to one side and grooves are cut into the other side of the foam slab. Concrete is poured over the grooved side so that the concrete fills the grooves and creates structural ribs. Pouring continues until a layer of concrete is formed on top of the foam slab. Reinforcing rods may be placed in the grooves to strengthen the ribs. No efficient anchoring or lateral connection means are provided.

Zimmerman, U.S. Pat. No. 4,751,803, issued on Jun. 21, 1988, describes a multi-layer insulating panel having preformed concrete ribs. The ribs, referred to as studs, have metal connecting members protruding from one edge. The ribs are placed in parallel relationship in a jig with the connecting members protruding upward. Additional ribs are formed to create a border around the inside of the jig. A layer of insulating material is placed on top of the ribs and the protruding members pierce through the insulation material. Wire mesh is laid over the insulating material and concrete poured on top of the mesh. The concrete hardens around the connecting members but does not form a true unitary structure.

Other references include Brostrom, U.S. Pat. No. 1,773,168 issued on Aug. 19, 1930; Branson, U.S. Pat. No. 1,840,304 issued on Jan. 12, 1932; Henzel, U.S. Pat. No. 2,321,813 issued on Jun. 15, 1943; Carroll, U.S. Pat. No. 4,090,336 issued on May 23, 1978; Lee, U.S. Pat. No. 4,380,887 issued on Apr. 26, 1983; Walston, U.S. Pat. No. 4,512,126 issued on Apr. 23, 1985; Pardo, U.S. Pat. No. 4,815,243, issued on Mar. 28, 1989; and Linetskii, Russian Patent Number 514,941 issued on Jun. 3, 1976.

It is thus an object of the present invention to provide a prefabricated panel having a simple design which is inexpensive to construct.

It is another object of the present invention to provide such a panel which has an exterior face of high strength and has superior insulating properties.

It is still another object of the present invention to provide such a panel which is simple to pour and permits rapid fabrication.

It is finally an object of the present invention to provide such a panel which has easy anchoring and interlock means for rapid, strong assembly.

SUMMARY OF THE INVENTION

The present invention accomplishes the above-stated objectives, as well as others, as may be determined by a fair reading and interpretation of the entire specification.

A prefabricated panel is provided for forming walls and roofs of buildings, and includes a concrete planar portion having a first face and a second face, at least one concrete rib projecting from the first face, at least one block of insulating material fitted adjacent to the first face and the at least one rib, a metal stud channel secured over at least one of the at least one rib, anchors for securing the panel to a foundation. A polystyrene strip is preferably contained within each metal stud channel. The prefabricated panel may additionally include a horizontal top edge, a concrete rib having an outer face projecting from the first face and extending along the top edge, a wooden plank secured along the outer face, and a truss plate for overlappingly fastening to the wooden plank to join the prefabricated panel to an adjacent prefabricated panel. The wooden plank may alternatively be a metal stud channel secured along the rib outer face. A polystyrene strip is preferably contained within the top edge metal stud channel. The panel anchor preferably includes a first angle-iron plate having first and second planar portions, the first planar portion being contained within one of the concrete ribs and the second planar portion being exposed and parallel with the exterior of the rib, a second angle-iron plate having first and second planar portions, the first planar portion being fastened to the second planar portion of first angle iron plate and the second planar portion being secured to the foundation. At least one reinforcing rod preferably extends through the first planar portion of the first angle-iron plate. The panel anchor alternatively includes a recess within one of the concrete ribs adjacent the foundation, a securing plate fitted within the recess and having an essentially planar base portion for fastening face to face against the foundation and at least two opposing edges, and a wing portion extending upwardly from each of the opposing edges, and a member for securing the wing portions within the rib. In the prefabricated panel described above, the at least one rib preferably includes an edge rib along each edge of the first face and a plurality of mutually parallel ribs extending between two of the edge ribs. A structure formed of such panels is also provided and includes a foundation having a ledge around its edges and several of the panels positioned vertically on the ledge and secured to the foundation to form walls. Additional panels may be placed across the tops of the vertically positioned panels to form a roof. These additional panels have at least one slot for receiving the tops of the vertically positioned panels. The anchoring mechanism preferably includes a securing plate having an essentially planar base portion for fastening face to face against the foundation and at least two opposing edges, and a wing portion extending upwardly from each of the at least two opposing edges, and a mechanism for securing the wing portions within the rib.

Where the panel includes two lateral panel edges, at least one lateral panel edge preferably has a lap projection for extending over a portion of an adjacent panel for concealing any gap between the adjacent panels. The panel may include a lateral edge securing plate having a vertical portion, and an upper horizontal portion and a lower horizontal portion both joined to the vertical portion so that one horizontal portion is above the other horizontal portion, a fastener for connecting the panel lateral edge to another panel, and a mechanism for securing the horizontal portions within the panel. The horizontal portions of the lateral edge securing plate preferably include opposing rod receiving bores, and the mechanism for securing the horizontal portions within the panel includes a rod member extending through the opposing rod receiving bores. The lateral edge may include one rib.

A prefabricated panel for forming walls and roofs of buildings includes a concrete planar portion having a first face and a second face, at least one concrete rib projecting from the first face, at least one block of insulating material fitted adjacent to the first face and the at least one rib, a furring strip secured over at least one of the at least one rib, and an anchoring mechanism for securing the panel to a foundation.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
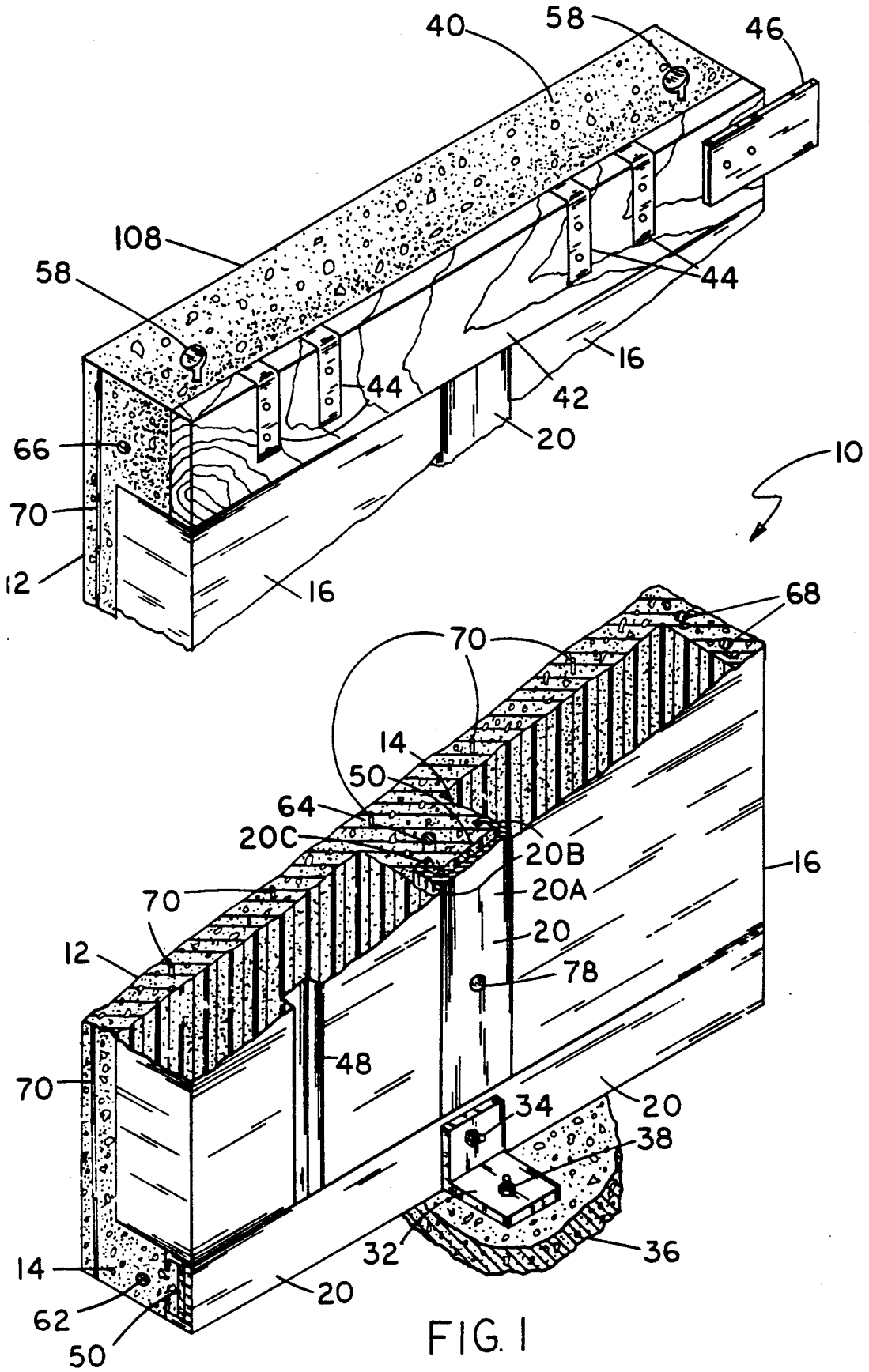
FIG. 1 is a perspective, broken view of the first preferred embodiment of the inventive panel, with broken lines showing the hidden edges of the blocks and the electric chase.
Figure 1D:
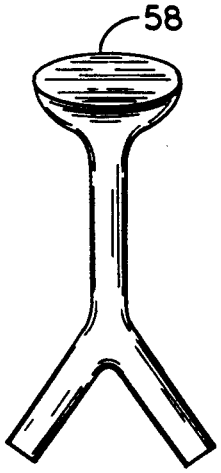
FIG. 1*d* is a side view of a lifter used in the panel shown in FIG. 1.
Figure 1C:
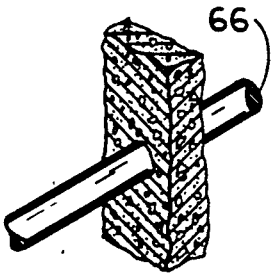
FIG. 1*c* is a perspective view of a reinforcing rod in the panel of FIG. 1 passing through a lifter.
Figure 1B:
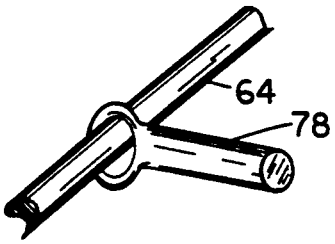
FIG. 1*b* is a perspective view of a reinforcing rod in the panel of FIG. 1 passing through a brace lug.
Figure 1A:
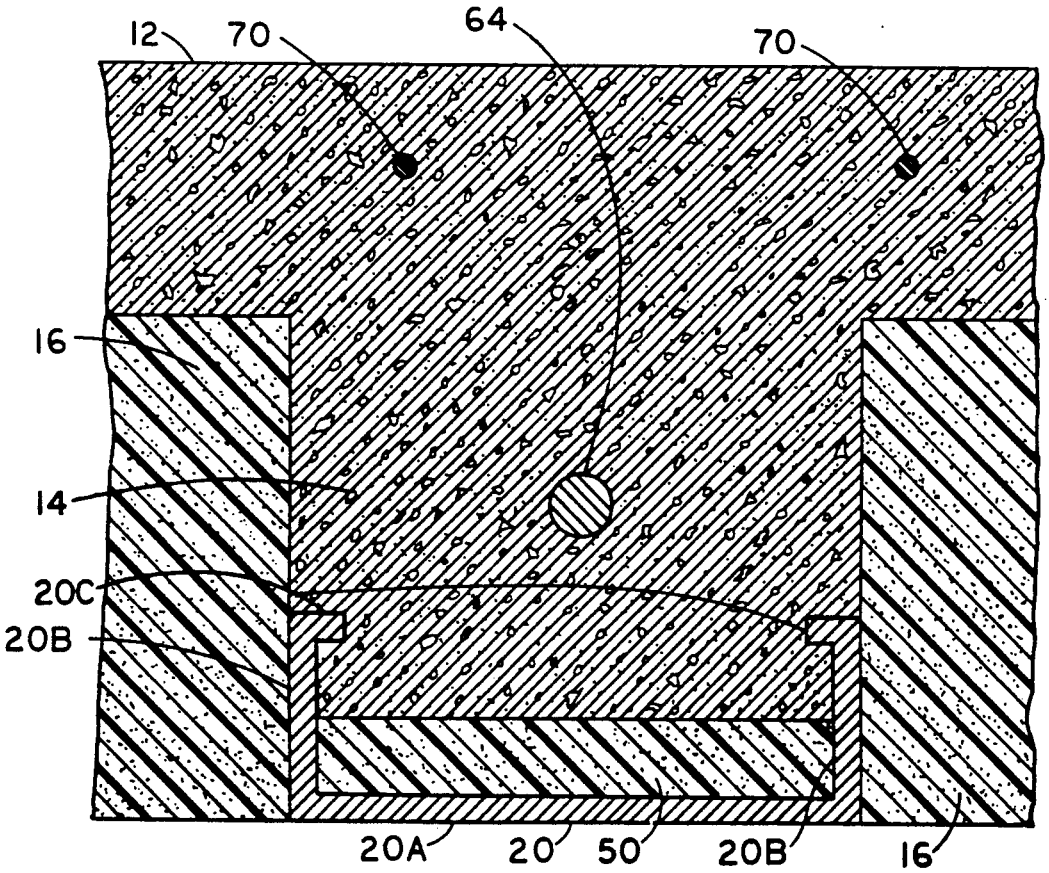
FIG. 1*a* is a top cross-sectional view of the panel of FIG. 1, showing in detail the structure and anchoring of the metal stud channel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIG. 1, a prefabricated panel 10 for forming walls and roofs of buildings is disclosed. Panel 10 has a concrete planar portion 12 with at least one rib 14 extending from a face thereof, and at least one block of polystyrene 16 fitted adjacent thereto, and a metal stud channel 20 containing a polystyrene strip 50, secured over each at least one rib 14 for receiving dry wall screws. See FIG. 1. Stud channel 20 is essentially Unshaped, having a stud receiving panel 20*a*, leg portions 20*b* extending from either edge of stud receiving panel 20*a*, and flange portions 20*c* extending from leg portions 20*b*. In forming panel 10, cement flows into channel 20 between leg portions 20*b* and around flange portions 20*c*. Upon curing, the concrete locks flange portions 20*c* and thus channel 20 into the at least one rib 14. A polystyrene strip 50 is preferably included within channel 20 for receiving studs driven through stud receiving panel 20*a* and for improved panel 10 insulation. Strip 50 is sufficiently spaced from flange portions 20*c* to permit the concrete to lock around portions 20*c*.

Figure 2:
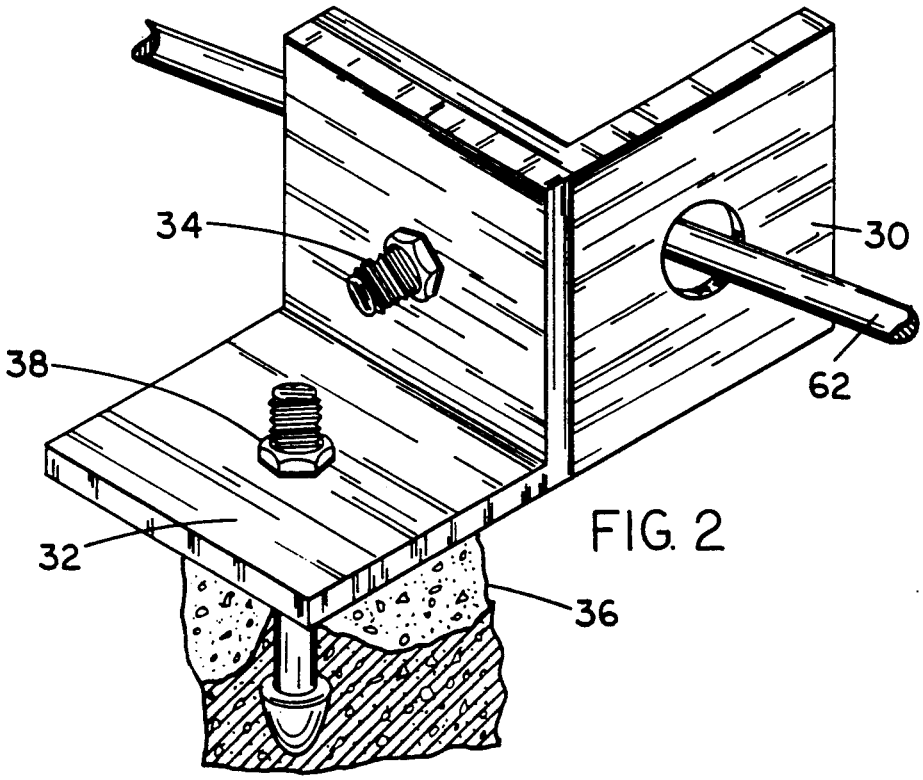
FIG. 2 is a perspective view of the angle iron plates only, shown joined together with the connecting bolt and floor anchor, and a section of reinforcing rod.

A horizontal concrete base rib 14 contains a first right angle-iron 30 positioned such that one face is exposed. See FIGURE 2. A second right angle-iron plate 32 is connected to the exposed face of first angle iron plate 30 with a nut 34. The bolt, which is one inch long and of number five grade, is welded to angle iron plate 30. Plate 32 is connected to the concrete building floor 36 with a wedge anchor and nut 38, also preferably being five and one half inches by one half inch. At the top end of each panel 10, planar portion 12 widens to form a concrete beam portion 40. A wooden plank 42 covers beam portion 40 and is held in place by mudsill anchors 44 embedded in beam portion 40. Truss plates 46 join planks 42 of adjacent panels 10. One or more electric chases 48 may be cut into polystyrene blocks 16 adjacent planar portion 12.

Preferred Embodiment and Method

Figure 3:
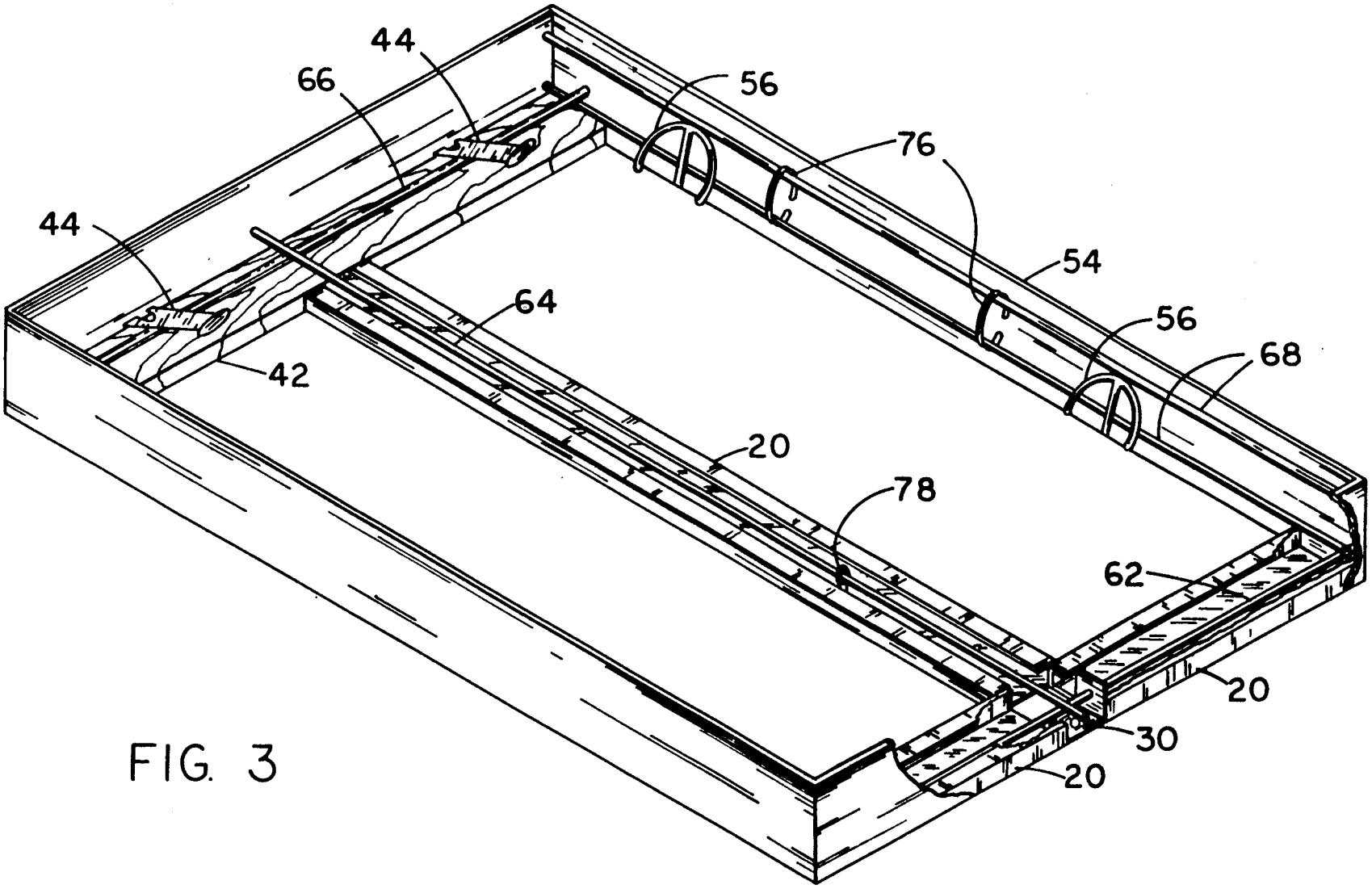
FIG. 3 is a perspective view of the jig containing the necessary reinforcing rods, mudsill anchors, chairs and C-hooks for pouring one of the inventive panels.
Figure 4:
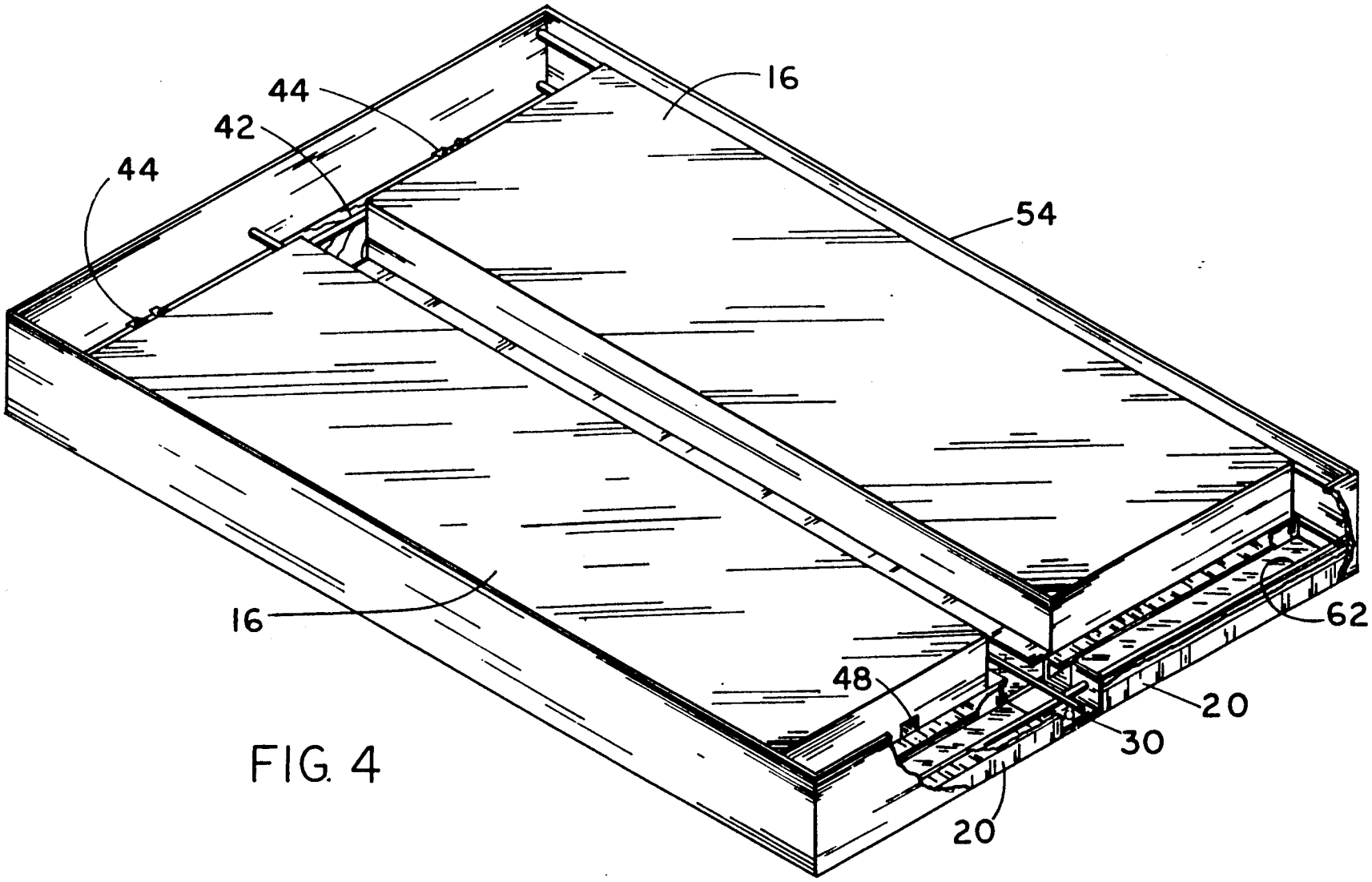
FIG. 4 is the jig of FIG. 3 additionally containing the polystyrene blocks.

Panel 10 of the present invention is formed by inserting polystyrene strip 50 inside a first metal stud channel 20 and laying first stud channel 20 broad face down inside a concrete form 54. See FIG. 3. Two additional, second stud channels 20 are preferably placed perpendicularly at a first end of first stud channel 20 to create a T-configuration. A block of polystyrene 16 is placed on each longitudinal side of f irst stud channel 20, leaving several inches of the second end of first stud channel 20 protruding beyond blocks 16. Blocks 16 are thicker than stud channels 20 and so rise higher in form 54 than stud channels 20, and the upper face of plank 42. See FIG. 4. A section of right angle iron plate 30 in the form of two planar plates of metal integrally joined together at a right angle and having a hole drilled through the center of each plate is placed at the first end of first stud channel 20. Angle iron plate 30 is oriented such that one plate rests flat against the bottom of form 54 at the intersection of the three channels 20, and the other, upright plate extends parallel to the longitudinal axis of the first stud channel 20. A length of reinforcing rod 62 positioned parallel to and above second stud channels 20 is fitted through the hole in the upright plate. A parallel reinforcing rod 66 is positioned above plank 42. Rod 66 extends through two lifters 58. See FIG. 1. Another reinforcing rod 64 is placed on chairs 56 above and parallel to first stud channel 20. See FIG. 3. A preferred reinforcing rod is Number 4. At least one brace lug 78 has a loop at an end which encircles rod 64. Brace lugs 78 brace panels 10 until panels 10 are joined by truss plates 46. Reinforcing rods 68 extend along the sides of form 54 parallel to rod 64, supported by chairs 56, which are preferably about three and three quarters inches high. Rods 68 are preferably connected by C-hooks 76, which are preferably the two and three quarter inch size.

Mudsill anchors 44, two feet on centers, as produced by Simpson are fastened to plank 42 and plank 42 is positioned perpendicular to first stud channel 20 at the second end thereof. Plank 42 is laid flat in the upper part of form 54 to complete panel 10.

Wire mesh 70 is placed on props horizontally over stud channels 20 and extends from plank 42 to the opposing end of form 54. The preferred wire mesh 70 is Number 6688. Finally, cement mix containing plasticizers is poured into form 54. The mix fills the low spaces around blocks 16, above stud channels 20, to form ribs 14. The mix also fills the space above plank 42 to form beam portion 40. Then, the mix covers blocks 16, creating planar portion 12 of panel 10. A vibrating roller is moved over the top of form 54 to smooth the exposed cement surface. As the mix cures, blocks 16 adhere to it and the mix becomes a high strength concrete.

Since a form 54 is used in the molding of panels 10, a variety of panel 10 shapes and sizes are possible. A panel 10 as described can be made to a length which stands one or two stories high when installed. By using proper form 54 inserts, doorways and windows, including those with arched tops, can be created in panels 10 during the forming process.

Ribs 14 add strength to panels 10 while polystyrene strips 50 in stud channels 20 prevent ribs 14 from becoming ports of thermal conductivity. Polystyrene strips 50 serve a dual purpose: to insulate in the gap between blocks 16, and to stabilize dry wall screws inserted through stud channels 20. Around windows and doors, two close, parallel ribs 14 are preferably provided.

Figure 5:
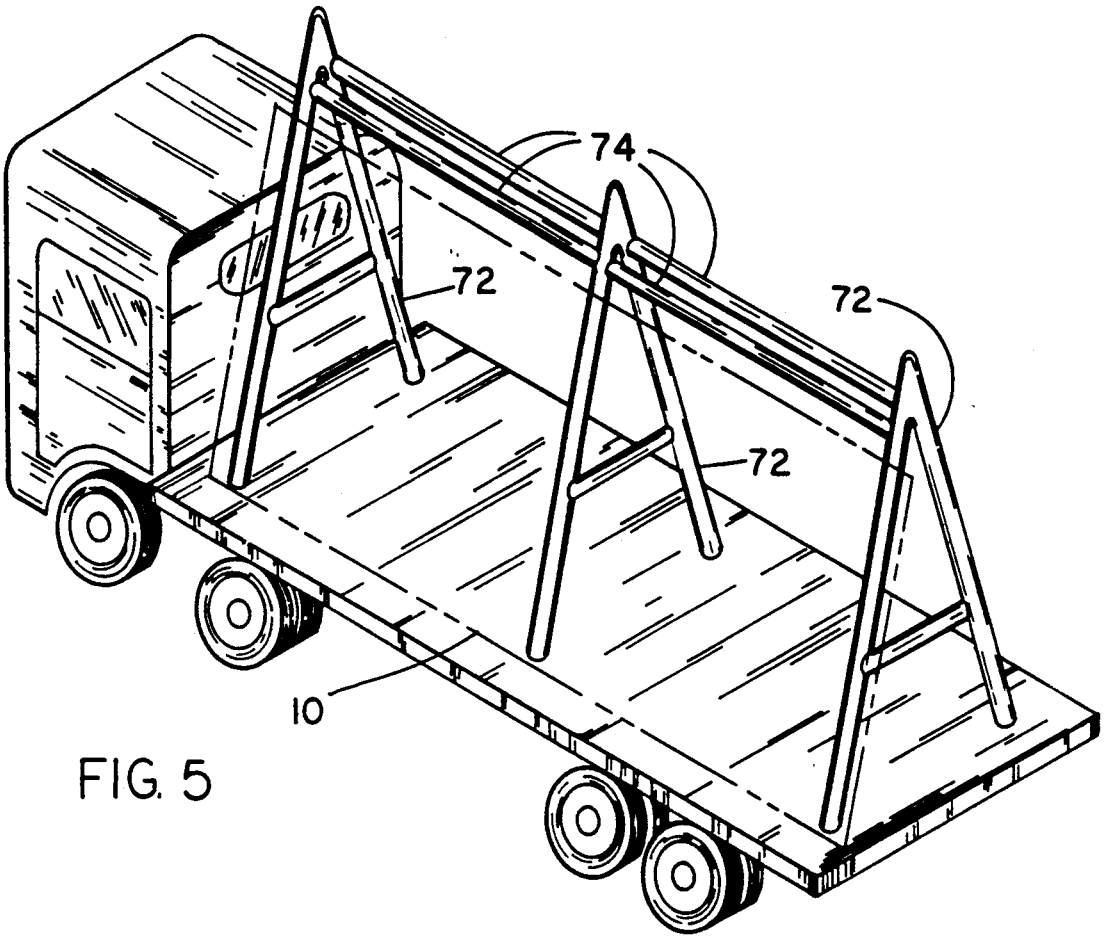
FIG. 5 is a perspective view of the flat bed truck with the inventive A-frame assembly for transporting the panels to the construction site.

Panels 10 are preferably transported in a vertical position from the sites where they are formed to the construction site. This is accomplished by leaning panels 10 against A-frame structures 72 joined by connecting struts 74 and secured to the upper surface of a flat bed truck trailer. See FIG. 5.

Preferred Panel Assembly

Figure 6:
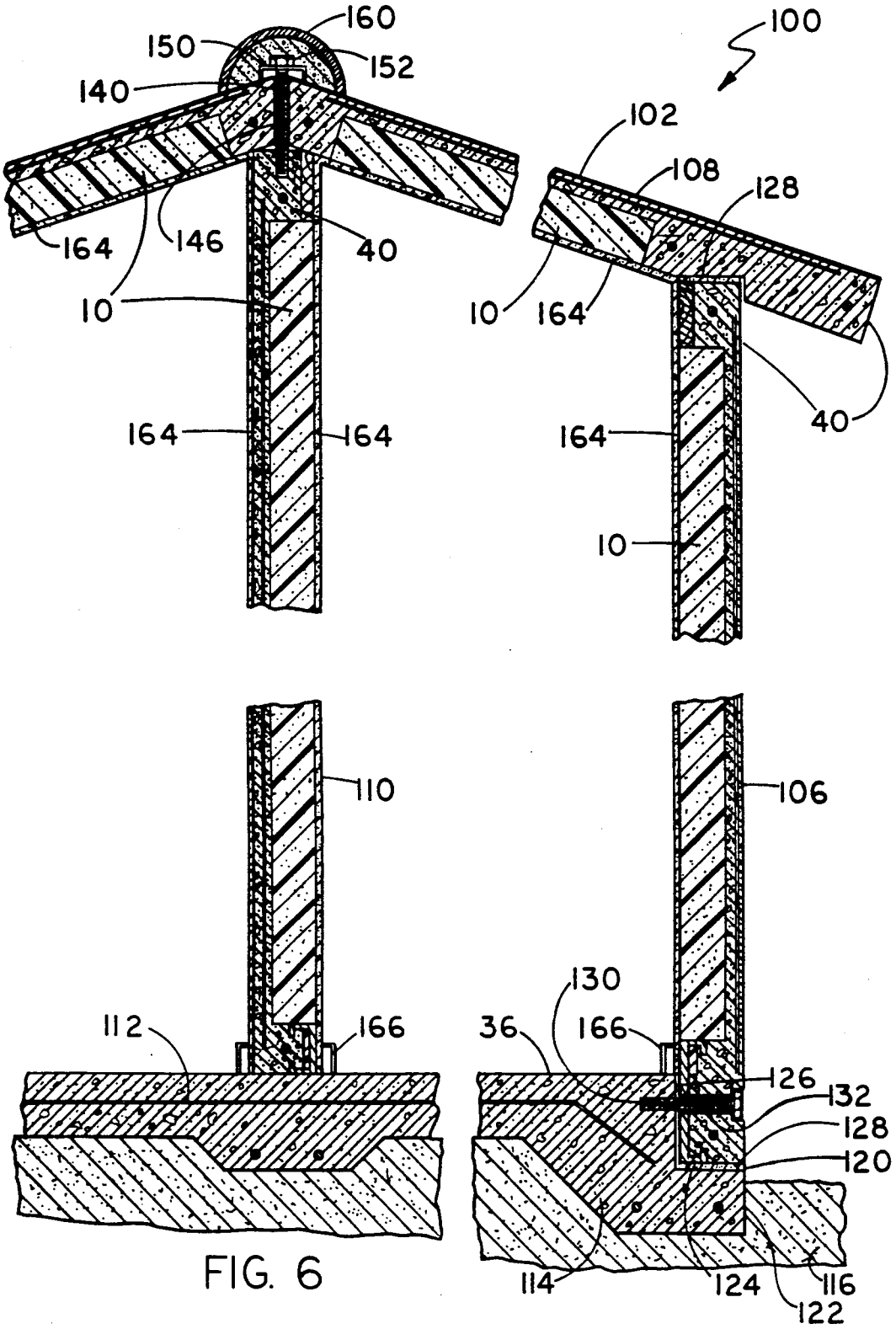
FIG. 6 is a cross-sectional side view of a building design having a pitched roof, constructed of the inventive panels.

A building or structure 100 may be constructed of panels 10. See FIGS. 6 and 7. FIG. 6 shows a cross-sectional side view of a structure 100 having a pitched roof 102, a front wall 106 and an interior wall 110. Roof 102 and all walls including front wall 106 and interior wall 110 are constructed of panels 10. The broad surface of planar portion 12 opposite ribs 14 forms the exterior surface 108 of the outer walls, such as front wall 106.

First a foundation 114 is poured which extends partly above ground 116, as shown in FIG. 6. Foundation 114 includes reinforcing metal 112. Ledges 120 are provided along each vertical edge 122 of foundation 114. Ledge 120 has a horizontal face 124 having a width approximately equal to that of a panel 10 and a vertical face 126. Sealant strips 128 are placed along horizontal faces 124. Base ribs 14 of several adjacent panels 10 are placed on ledge 120 so that panels 10 stand vertically, with their beam portions 40 at the top and exterior surfaces 108 directed away from vertical faces 126. A plurality of holes are horizontally bored through base ribs 14 and a expansion bolt 130, preferably half inch anchor bolt, is inserted through each hole 132 into foundation 114. Panels 10 for the remaining exterior walls are seated in ledges 120 and attached in the same way. Expansion bolts 38 are additionally employed to secure these vertical panels 10 to building floor 36. Sealant strips 128 are placed on top of beam portions 40.

Interior wall 110 supports the peak 140 of roof 102. Thus, wall 110 is formed of panels 10 which are formed to be longer than panels 10 for front wall 106 or the rear wall to permit the middle of roof 102 to rise to a peak 140. To form interior wall 110, panels 10 are placed parallel to front wall 106, with base ribs 14 against building floor 36 and beam portions 40 at their tops. Wall 110 is preferably equidistant from the front 106 and back exterior walls. Expansion bolts 38 secure wall 110 to floor 36. Adjacent panels 10 forming wall 110 are connected with one half inch expansion bolts. Sealant strips 128 are placed on top of beam portions 40.

Panels 10 used to form roof 102 are specially poured. These panels 10 have wide beam portions 40 having a notch 174 for fitting over the beam portions 40 of the exterior side walls, including front wall 106. See FIG. 6. Beam portions 40 are preferably wide enough to form an overhang, as illustrated. The edge faces 146 of base ribs 14 are angled to meet vertically on top of interior wall 110. A peak channel member 150 is placed over peak 140 formed by roof panels 10 meeting at their base rib edge faces 146. Threaded bolts 152 extend vertically down through channel member 150 between adjacent edge faces 146 and into anchors in the beam portions of interior wall 110. Coping 160 having a semicircular cross-section is filled with mortar and placed over channel member 150. A waterproof coating is spread over exterior surfaces 108 of roof panels 10.

As final steps, a stucco skim coat 164 is spread over all panel 10 surfaces facing the interior of structure 100. Electrical baseboard chases 166 may be placed along the corners where panels 10 meet floor 36.

Figure 7:
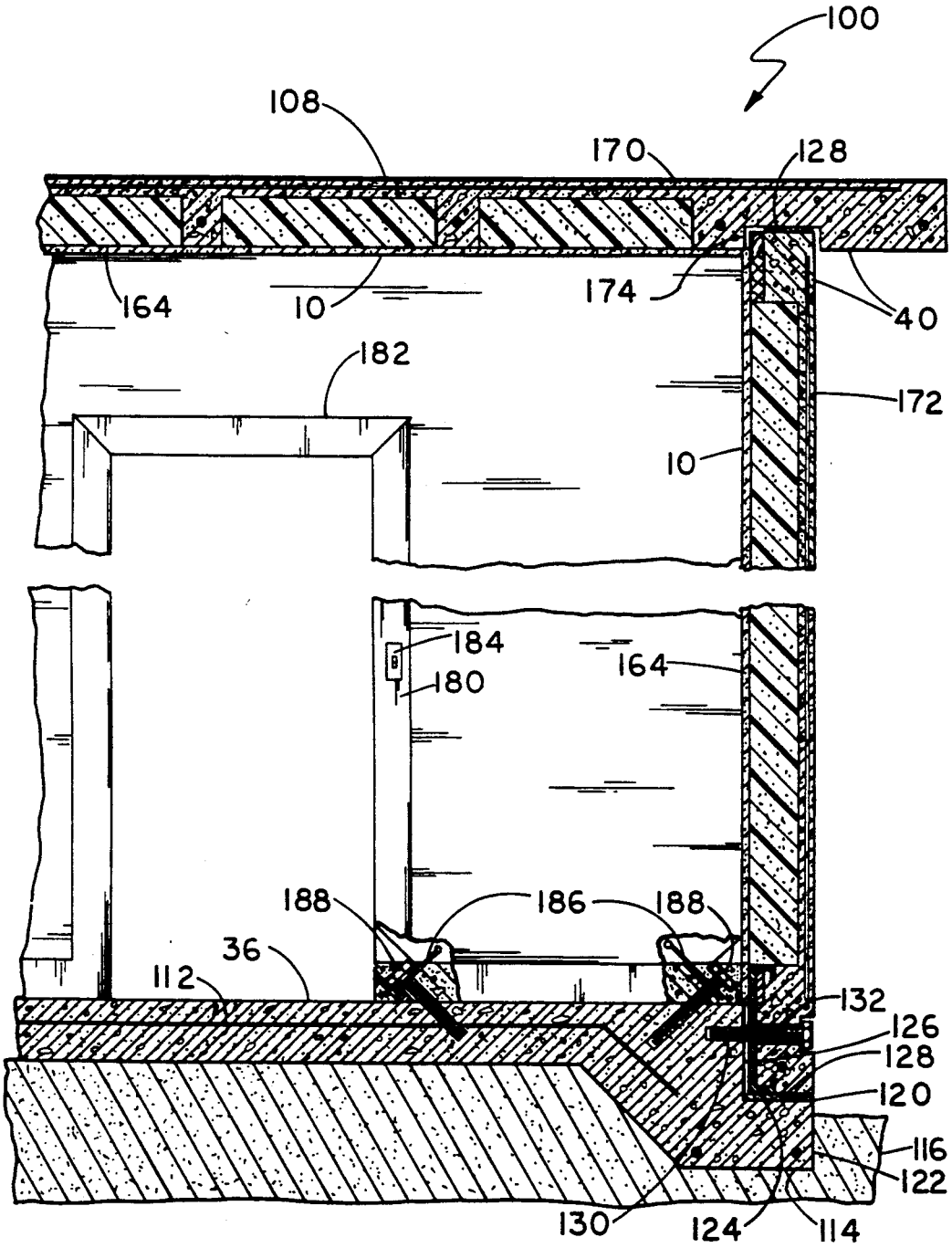
FIG. 7 is a cross-sectional front view of the building design illustrated in FIG. 6.

Structure 100 may also have a level roof 170 formed of panels 10, as mentioned above and illustrated in FIG. 7. The arrangement of panels 10 is as above for the peaked roof structure 100, except that interior wall 110 is made of a height equal to that of the exterior side walls, including front wall 106. Rib 14 of roof panels 10 located along the exterior side walls 172 bordering front wall 106 are poured to be wide so that a notch 174 can be formed in them to receive the tops of side wall 176 beam portions 40. FIG. 7 illustrates how electrical chases 180 extend around a doorway 182 and around a switch 184. Bolts 186 extend through base ribs 14 and into floor 36 at approximately a forty-five degree angle from the horizontal. Bolts 186 are preferably half inch diameter Epcon bolts and extend into a PVC case in foundation 114. Hair pins 188 are driven perpendicularly through bolts 186 to secure bolts 186 against axial movement once in place.

Second Preferred Embodiment

Figure 8:
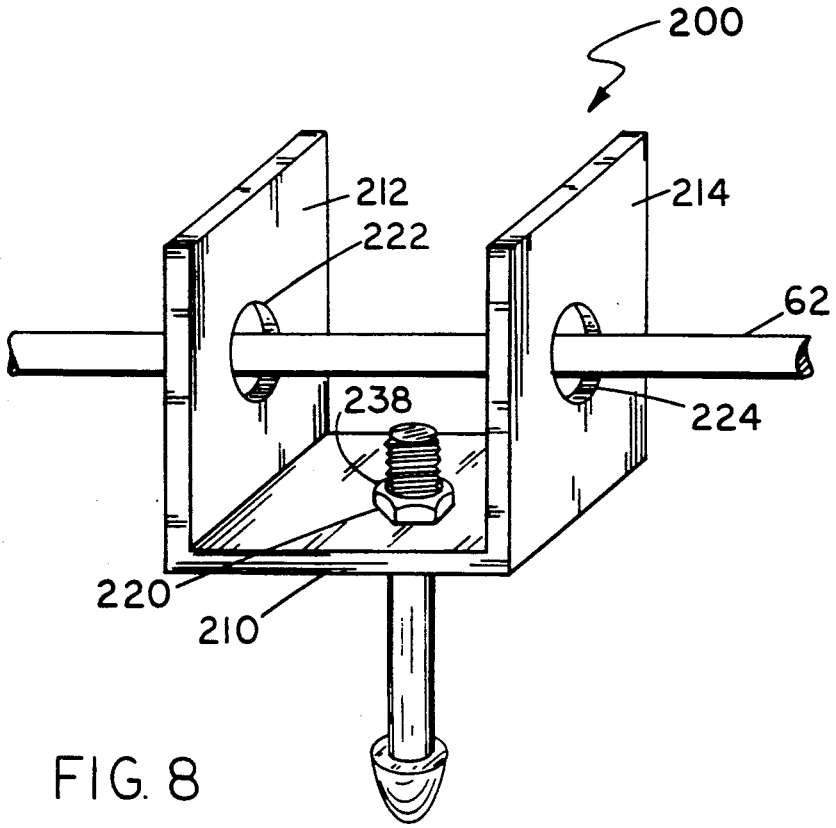
FIG. 8 is a perspective view of the channel member of the second preferred embodiment only, shown with the floor anchor and a section of reinforcing rod.
Figure 9:
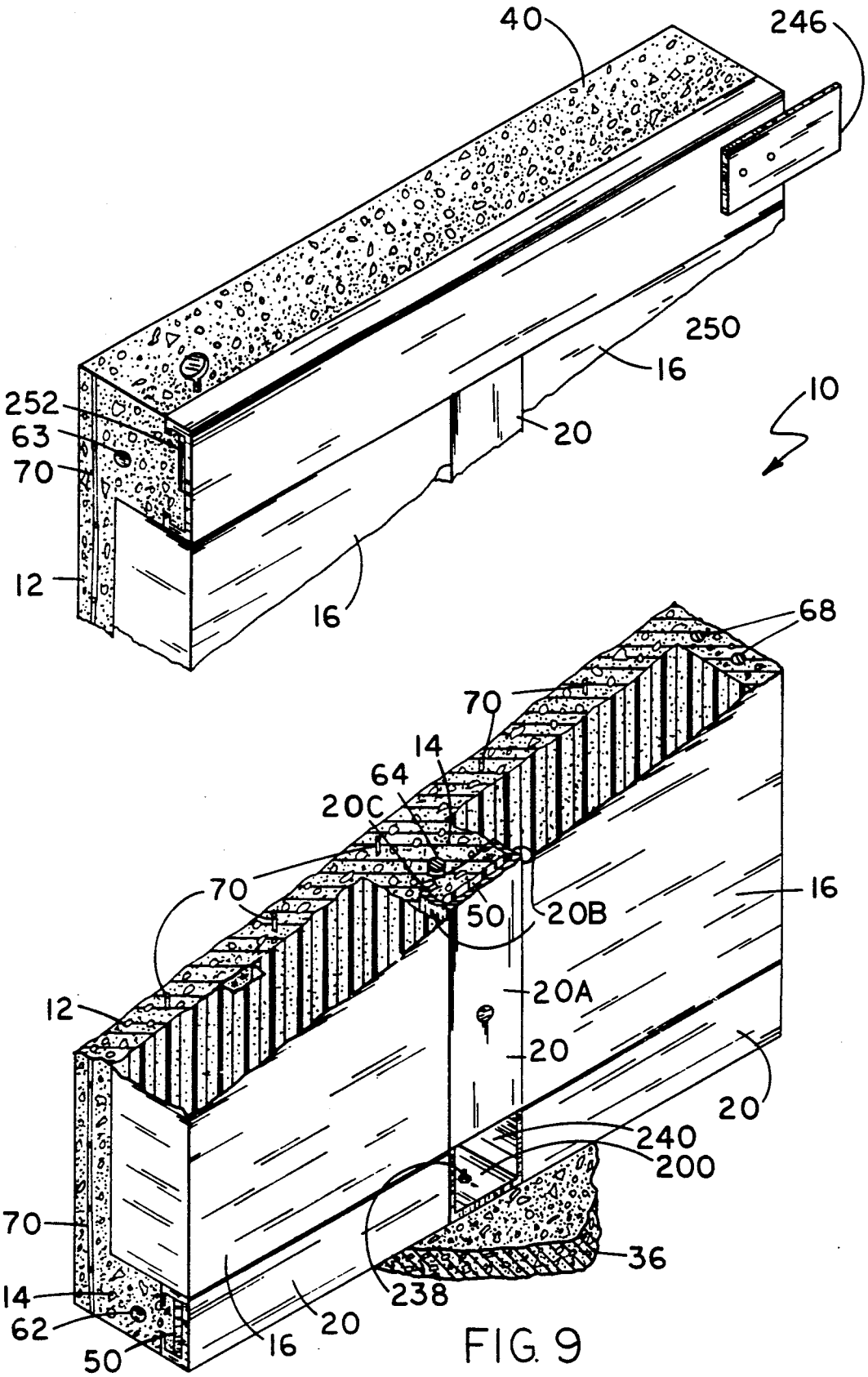
FIG. 9 is a perspective, broken view of the second preferred embodiment of the inventive panel, with broken lines showing the hidden edges of the blocks and the electric chase.
Figure 9B:
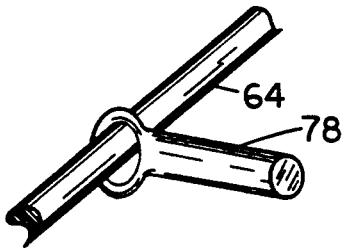
FIG. 9*b* is a perspective view of reinforcing rod passing through a brace lug in the panel of FIG. 9.
Figure 9A:
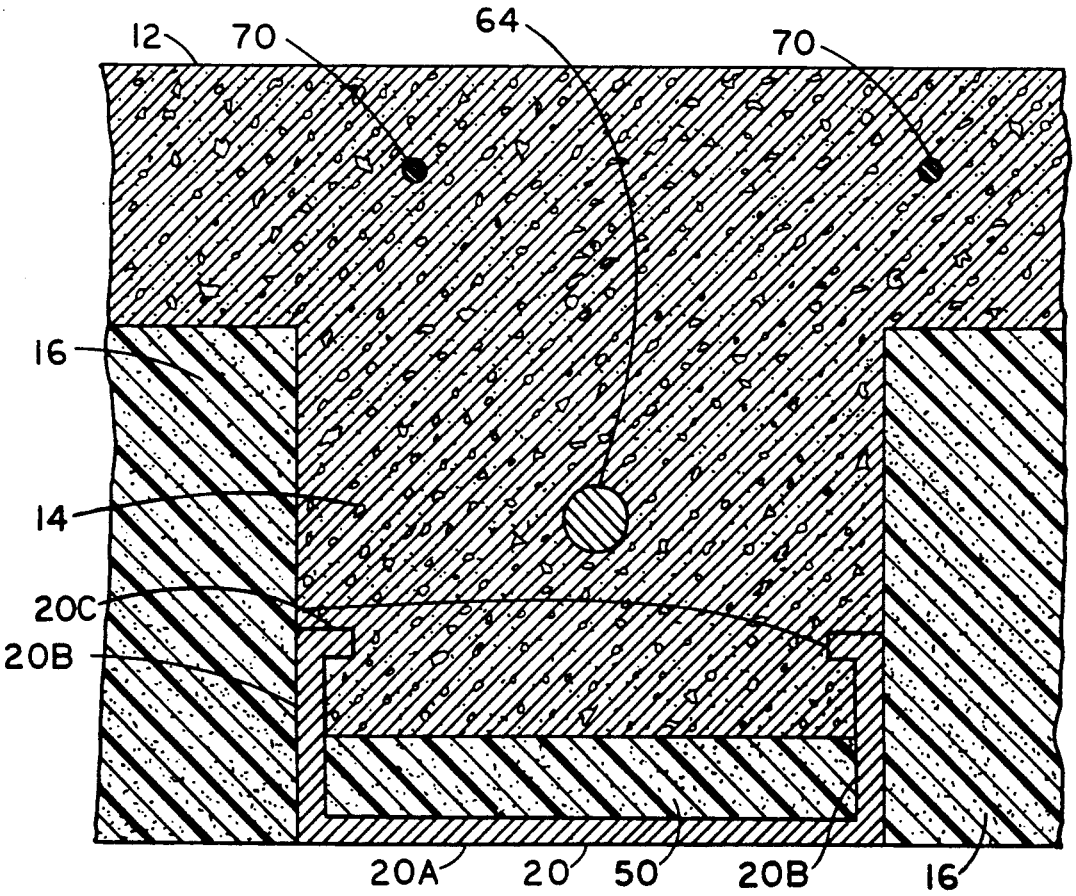
FIG. 9*a* is a top cross-sectional view of the panel of FIG. 9, showing in detail the structure and anchoring of the metal stud channel.

The panel 10 of the second preferred embodiment is constructed according to the same method and takes the same final structure as the panel 10 of the first embodiment, with the following exceptions. In place of first and second right angle-iron plates 30 and 32, respectively, a channel member 200 is provided as illustrated in FIGS. 8, 9 and 9*a*. Channel member 200 includes a horizontal, bottom plate 210 and two parallel vertical plates 212 and 214 extending from opposing edges of bottom plate 210. Plates 210, 212 and 214 are preferably a single unified plate bent into the described configuration. Bottom plate 210 rests flat against building floor 36 and has a central port 220 through which a wedge anchor and nut 238 extend into floor 36. Reinforcing rod 62 extends through mutually aligned ports 222 and 224 in vertical plates 212 and 214, respectively, securing channel member 200 within panel 10.

Grout must fill in and around first angle iron 30, while channel member 200 defines a void recess 240 in bottom rib 14. The volume of recess 240 equals the volume of grout saved by using channel member 200.

Recess 240 preferably contains a snug fitting block 244 of polystyrene for enhancing insulating characteristics.

The second preferred embodiment also differs from the first at the upper portion of panel 10. Wooden plank 42, which covers beam portion 40, is replaced with a wide stud channel 250 made of twenty gauge steel. See FIG. 9. Channel 250 is joined to the panel rib structure in the same manner as channels 20, and also contains a polystyrene strip 252. One panel 10 is joined to an adjacent panel 10 by overhanging truss plates 246, which are formed of twenty gauge steel for added strength. As a result of the heavy gauge of channel 250 and truss plates 246, screws 256 are used to fasten channel 250 and truss plates 246 together, rather than nails. The increase in truss plate gauge permits a narrowing in truss plate area, so that truss plate 246 is preferably only about half the width of truss plate 46 of the first embodiment, as can be seen by comparing FIGS. 1 and 9.

Figure 10:
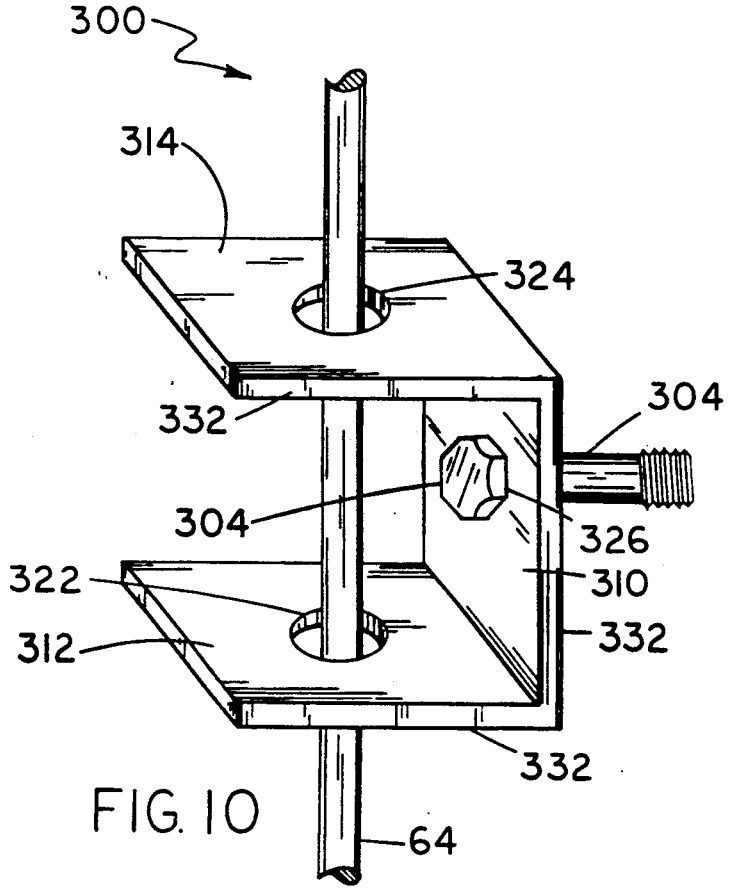
FIG. 10 is a perspective view of the channel member for lateral fastening of adjacent panel edges, shown with the channel member connecting bolt and a section of reinforcing rod.

A preferred alternative to truss plates 246 to connect adjacent parallel panels 10 is a pair of opposing channel members 300, imbedded in an opposing edges 302 of panels 10, and fastened together by a bolt 304. See FIG. 10. Channel members 300 are very similar to channel members 200. Each channel member 300 includes a vertical plate 310. A horizontal bottom plate 312 extends from the bottom edge of plate 310 in a given direction and a matching horizontal top plate 314 extends from the top edge of plate 310 in the same direction. Plates 310, 312 and 314 are preferably a single, unified rectangular plate bent into the described configuration. The axial length of a channel member 300 is preferably less than the panel 10 width. Plates 312 and 314 have opposing bores 322 and 324 sized to receive a concrete reinforcing rod 64. Bores 322 and 324 are mutually offset from the center points of plates 312 and 314 along the axis of channel member 300. Plate 310 has a central bolt port 326. Bolt port 326 may be elongated in a direction perpendicular to plates 312 and 314 to permit vertical play between adjacent panels 10.

A channel member 300 is preferably inserted into a panel 10 during panel molding, immediately below stud channel 250. Channel member 300 is positioned such that vertical plate 310 fits flush along and forms a part of a panel vertical edge 302, which would normally comprise a rib 14. See FIG. 11. Plates 312 and 314 extend into panel 10 essentially perpendicular to panel vertical edge 302. A vertical reinforcing rod 64 within rib 14 passes through opposing bores 322 and 324 to anchor channel member 300 in panel 10 one cross-sectional edge 332 of channel member 300 is essentially flush with the face of the rib 14 in which it is embedded. A polystyrene or other type of removable mold insert is placed within channel member 300 during panel 10 molding to create a hollow 330 within channel member 300 to about one half to two thirds of the channel member 300 axial depth. Bores 322 and 324 are preferably sufficiently axially offset along channel member 300 from the center points of plates 312 and 314, that concrete covers the portion of rod 64 extending next to hollow 330.

When panel 10 is installed, hollow 330 receives a panel connecting bolt 304. The shank of connecting bolt 304 is inserted through bolt port 326 and into the bolt port 326 of an adjacent panel 10. See FIG. 11. A nut (not shown) is inserted in the hollow 330 of the adjacent panel 10 channel member 300 and fastened over bolt 304 to join the adjacent panels 10 together. Then a foam block may be fitted into each hollow 330 to increase insulation at the hollow 330 location.

Another preferred alternative feature is mating lap extensions 340 and 342 along vertical panel edges 302. See FIG. 11. Each lap extension 340 and 342 preferably has a width between one third and one half of the panel 10 width, and protrudes about an equal distance from edge 302 one mating panel edge 302 has an inside lap extension 340 extending flush from the panel 10 inside face 344 and the opposing edge 302 of the adjacent panel has an outside lap extension 342 extending flush from the panel 10 outside face. Shims may be placed around abutting sides of lap extensions 340 and 342 to stabilize and position the adjacent panels 10 relative to each other. At building corners, the inside face 344 of one panel 10 extends across an ordinary flat vertical edge 302 of the abutting panel 10. Countersunk expansion bolts 38 extend through the first panel 10 and into the abutting edge 302 of the adjacent panel 10. See FIG. 12. Shims 348 help position and brace panels 10 relative to each other. A corner gusset plate 356 is preferably secured over stud channels 250 for added strength. See FIG. 12*a*.

This inventive overlapping design completely blocks any direct light or wind from passing through adjacent parallel panels 10. This feature is particularly valuable in a hurricane, where the integrity of a structure against wind entrance is crucial.

Figure 11:
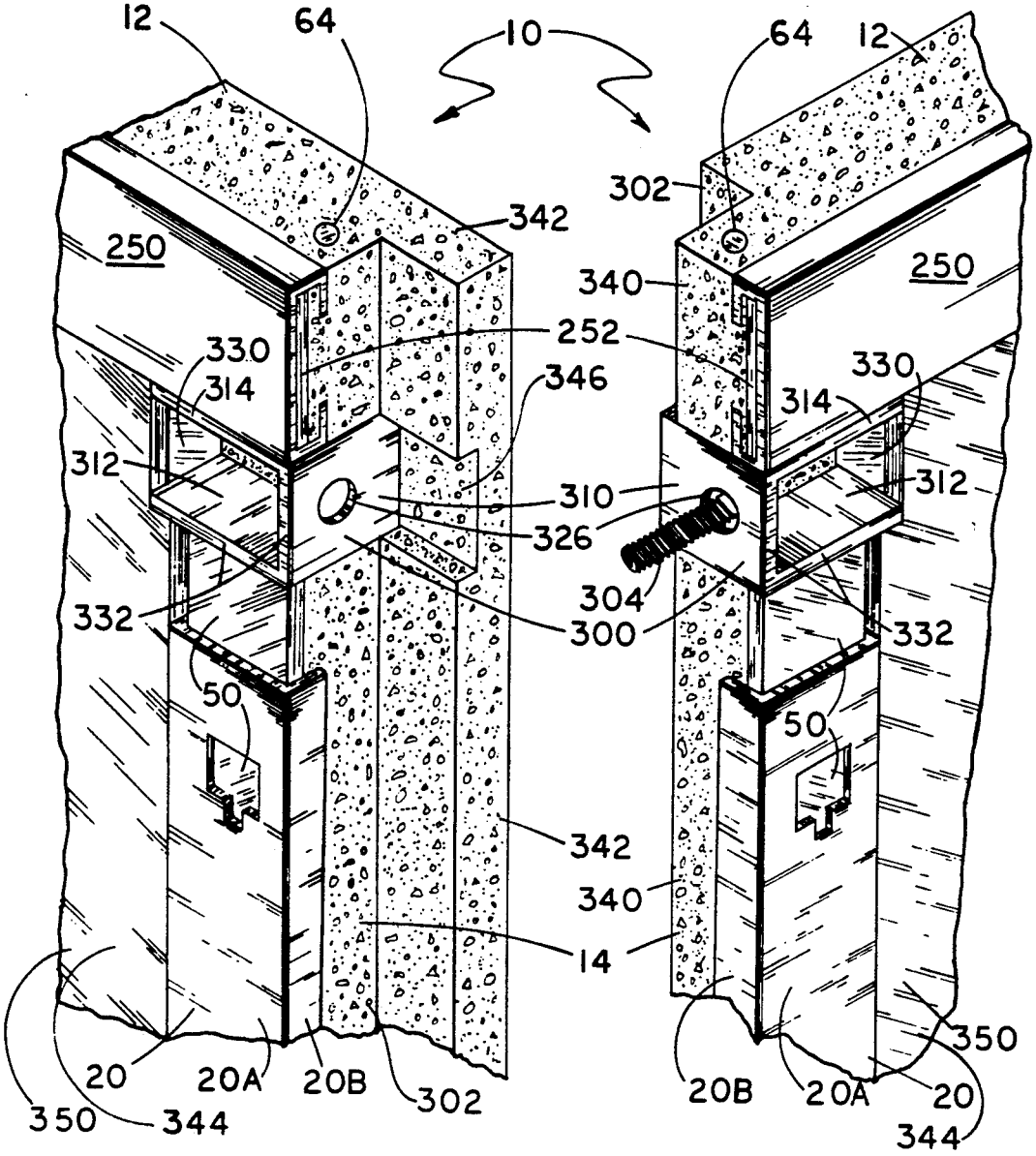
FIG. 11 is a perspective view of portions of two panels to be placed in a lateral edge to lateral edge essentially parallel position, illustrating the lateral fastening channel member feature and the lap projection feature for concealing any gap between the panels. The vertical stud channels include essentially square openings which expose a portion of the foam strip inside the stud channel, to provide access to a possible wiring chase cut axially along the foam strip.
Figure 12A:
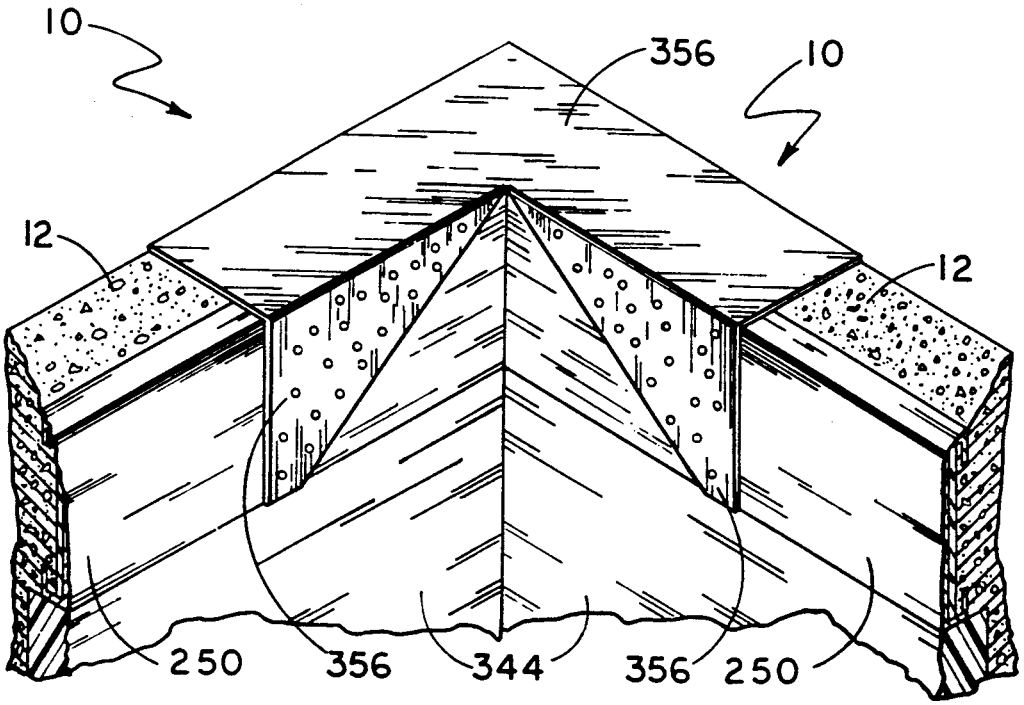
FIG. 12*a* is a perspective view of a portion of a pair of panels forming a corner, and a corner gusset plate joining the panels at their top edges.
Figure 12:
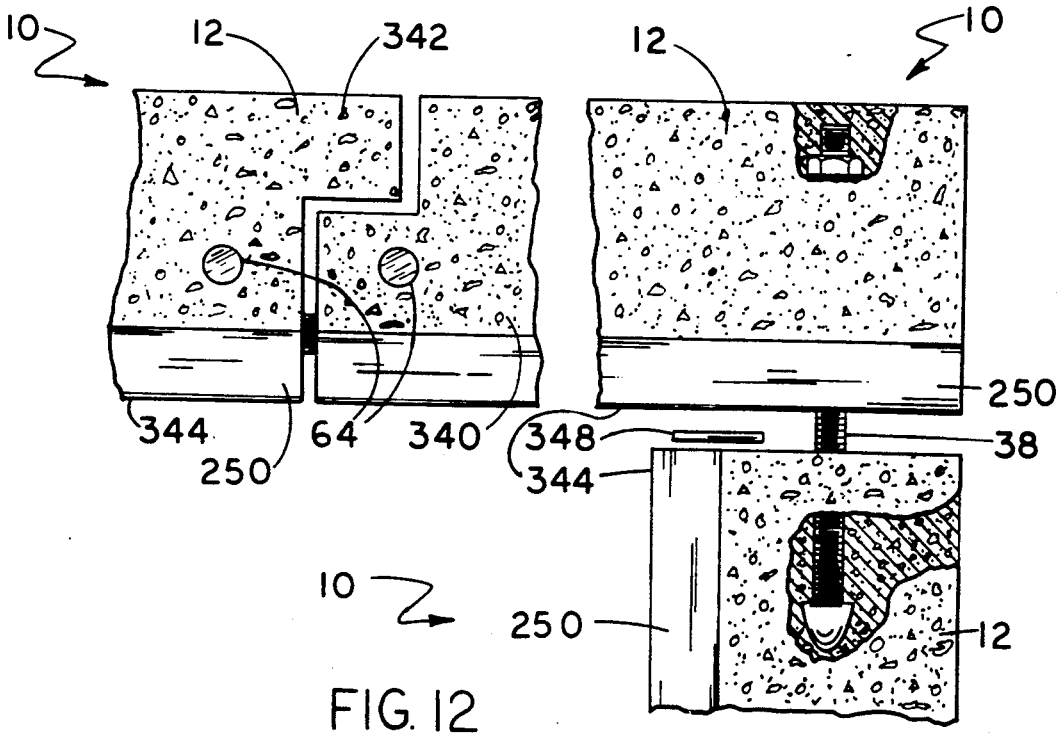
FIG. 12 is a top plan view of the panels of FIG. 11, additionally including a third panel positioned perpendicularly to the first two panels to represent a building corner. Countersunk expansion bolts, such as one shown in broken lines, fastens these corner panels together.

The overlapping edge 302 feature may be used in conjunction with the channel member 300 panel connecting feature, as shown in FIG. 11. A recess 346 may be provided in the outer lap extension 342 of one panel 10 to receive a portion of the channel member 300 of the adjacent panel 10.

A half inch thick layer of foam 350 is preferably placed over the inside face 344 of panels 10 for added insulating.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A prefabricated panel for forming walls and roofs of buildings, comprising:

a concrete planar portion having a first face and a second face, at least one concrete rib projecting from said first face end having a rib outer face, at least one block of insulating material fitted adjacent to said first face and said at least one rib, a metal stud member adapted to receive drywall anchoring fasteners comprising a metal sheet secured substantially parallel to and spaced apart from said rib outer face with rib connecting and spacing means, anchoring means for securing said panel to a foundation.

2. A prefabricated panel as in claim 1, wherein said metal stud member comprises a metal stud channel and wherein said rib connecting and spacing means comprises a side of said metal stud channel, additionally comprising a polystyrene strip contained within each said metal stud channel.

3. A prefabricated panel as in claim 1, additionally comprising:

a horizontal top edge, a concrete rib having an outer face, projecting from said first face and extending along said top edge, a wooden plank secured to said outer face, a connecting plate for overlappingly fastening to said wooden plank to join said prefabricated panel to an adjacent prefabricated panel.

4. A prefabricated panel as in claim 1, additionally comprising:

a horizontal top edge, a concrete rib having a rib outer face, projecting from said first face and extending along said top edge, a top edge metal stud member for receiving drywall anchoring fasteners comprising a metal sheet secured substantially parallel to and spaced apart from said rib outer face with rib connecting and spacing means secured to said outer face, a connecting plate for overlappingly fastening to said top edge metal stud member to join said prefabricated panel to an adjacent prefabricated panel.

5. A prefabricated panel as in claim 4, wherein said metal stud member comprises a metal stud channel and wherein said rib connecting and spacing means comprises a side of said metal stud channel, additionally comprising a polystyrene strip contained within said metal top edge stud channel.

6. A prefabricated panel as in claim 1, wherein said anchoring means comprises:

a first angle-iron plate having first and second planar portions, the first planar portion being contained within one of said concrete ribs and the second planar portion being exposed and parallel with the exterior of said rib, a second angle-iron plate having first and second planar portions, the first planar portion being fastened to the second planar portion of first angle iron plate and the second planar portion being secured to the foundation.

7. A prefabricated panel as in claim 6, additionally comprising at least one reinforcing rod extending through said first planar portion of said first angle-iron plate.

8. A prefabricated panel as in claim 1, wherein said anchoring means comprises:

a recess within one of said concrete ribs adjacent the foundation, a securing plate fitted within said recess and having an essentially planar base portion for fastening face to face against the foundation and at least two opposing edges, and a wing portion extending upwardly from each of said opposing edges, means for securing said wing portions within said one of said ribs.

9. A prefabricated panel as in claim 8, additionally comprising at least one reinforcing rod extending through said wing portions of said securing plate.

10. A prefabricated panel as in claim 1, wherein said at least one rib comprises an edge rib along each edge of said first face and a plurality of mutually parallel ribs extending between two of said edge ribs.

11. A structure formed of panels as set forth in claim 1, comprising:

a foundation having ledge means around its edges, a plurality of said panels positioned vertically on said ledge means and secured to said foundation to form walls.

12. A structure as in claim 11, additionally comprising:

additional said panels placed across the tops of said vertically positioned panels to form a roof.

13. A structure as in claim 12, wherein the additional said panels have at least one slot for receiving the tops of said vertically positioned panels.

14. A prefabricated panel as in claim 1, additionally comprising:

two lateral panel edges, at least one said lateral panel edge comprising a lap projection for extending over a portion of an adjacent said panel for concealing any gap between said adjacent panels.

15. A prefabricated panel as in claim 1, additional comprising:

a lateral edge;

a lateral edge securing plate having a vertical portion, and an upper horizontal portion and a lower horizontal portion both joined to said vertical portion such that one said horizontal portion is above the other said horizontal portion, fastener means for connecting said panel lateral edge securing plate to another panel, means for securing said horizontal portions within said panel lateral edge.

16. A prefabricated panel as in claim 15, wherein said horizontal portions of said lateral edge securing plate comprise opposing rod receiving bores, and wherein said means for securing said horizontal portions within said panel lateral edge comprises a rod member extending through said opposing rod receiving bores.

17. A prefabricated panel as in claim 16, wherein said lateral edge comprises one said rib.

18. A prefabricated panel for forming walls and roofs of buildings, comprising:

a concrete portion, panel anchoring means comprising a first angle-iron plate having first and second planar portions, the first planar portion being contained within said concrete portion and the second planar portion being exposed and parallel with the exterior of the panel, a second angle-iron plate having first and second planar portions, the first planar portion being fastened to the second planar portion of first angle iron plate and the second planar portion being secured to the foundation.

19. A prefabricated panel for forming walls and roofs of buildings, comprising:

a concrete planar portion having a first face and a second face, at least one concrete rib projecting from said first face, at least one block of insulating material fitted adjacent to said first face and said at least one rib, anchoring means for securing said panel to a foundation, comprising a first angle-iron plate having first and second planar portions, the first planar portion being contained within one of said concrete ribs and the second planar portion being exposed and parallel with the exterior of said rib, and a second angle-iron plate having first and second planar portions, the first planar portion being fastened to the second planar portion of first angle iron plate and the second planar portion being secured to the foundation.

20. A prefabricated panel for forming walls and roofs of buildings, comprising:

a concrete portion, panel anchoring means comprising a securing plate having an essentially planar base portion for fastening face to face against the foundation and at least one edge, and a wing portion extending upwardly from said at least one edge, means for securing said wing portion within said concrete portion.

21. A prefabricated panel for forming walls and roofs of buildings, comprising:

a concrete planar portion having a first face and a second face, at least one concrete rib projecting from said first face, a substantially U-shaped stud channel comprising a stud receiving panel portion, two leg portions, and a flange portion protruding from at least one said leg portion substantially toward the other said leg portion, anchored to said at least one rib by concrete extending from said rib into said stud channel portion and around said flange portion, anchoring means for securing said panel to a foundation.

22. A prefabricated panel as in claim 21, additionally comprising a polystyrene strip contained within each said metal stud channel for increasing insulation and receiving studs inserted through said stud receiving panel portion.

23. A prefabricated panel as in claim 21, additionally comprising:

a horizontal top edge, a concrete rib having an outer face, projecting from said first face and extending along said top edge, a wooden plank secured to said outer face, a truss plate for overlappingly fastening to said wooden plank to join said prefabricated panel to an adjacent prefabricated panel.

24. A prefabricated panel as in claim 21, wherein said anchoring means comprises:

a securing plate having an essentially planar base portion for fastening face to face against the foundation and at least two opposing edges, and a wing portion extending upwardly from each of said at lest two opposing edges, means for securing said wing portions within said at lest one rib.

25. A prefabricated panel for forming walls and roofs of buildings, comprising:

a concrete portion comprising a lateral edge, anchoring means for securing said panel to a foundation, a lateral edge securing plate comprising a vertical portion, an an upper horizontal portion and a lower horizontal portion both joined to said vertical portion such that one said horizontal portion is above the other said horizontal portion, fastener means for connecting said lateral edge securing plate to another panel, means for securing said horizontal portions within said panel lateral edge.

26. A prefabricated panel as in claim 25, wherein said horizontal portions of said lateral edge securing plate comprise opposing rod receiving bores, and wherein said means for securing said horizontal portions within said panel lateral edge comprises a rod member extending through said opposing rod receiving bores.

27. A prefabricated panel for forming walls and roofs of buildings, comprising:

a concrete planar portion having a first face and a second face, at lest one concrete rib projecting from said first face, an essentially U-shaped stud channel comprising a stud receiving panel portion, at least one leg portion, and a flange portion protruding from at least one said leg portion and anchored to said at least one rib by concrete extending from said rib into said stud channel portion and around said flange portion, anchoring means for securing said panel to a foundation.

* * * * *